United States Patent [19]

Munck

[11] 4,304,594

[45] Dec. 8, 1981

[54] HARDENING OF METALS

[76] Inventor: Ellsworth G. Munck, 8624 Whippoorwill La., Parma, Ohio 44130

[21] Appl. No.: 138,497

[22] Filed: Apr. 9, 1980

[51] Int. Cl.[3] ..... C22B 4/00

[52] U.S. Cl. ..... 75/10 R; 75/65 R; 148/13; 148/32; 148/154; 164/48

[58] Field of Search ..... 148/13, 154, 32; 75/10 R, 65 R, 93; 164/52

[56] References Cited

U.S. PATENT DOCUMENTS

| | | | |
|---|---|---|---|
| 3,235,416 | 2/1966 | Jenkins | 148/154 |
| 3,341,371 | 9/1967 | Baumgartner | 148/154 |
| 4,021,274 | 5/1977 | Chadwick | 148/154 |

*Primary Examiner*—P. D. Rosenberg

*Attorney, Agent, or Firm*—Dressler, Goldsmith, Shore, Sutker & Milnamow

[57] ABSTRACT

Hardened metals are produced by subjecting molten metals to the action of an electrostatic field of at least 1000 volts during the cooling and solidification of the metal.

18 Claims, 9 Drawing Figures

HARDENING OF METALS

TECHNICAL FIELD OF THE INVENTION

This invention is in the field of metallurgy and relates to a method and apparatus for producing hardened metals and to a hardened metal produced thereby.

BACKGROUND OF THE INVENTION

There are a limited number of metals in nature from which to choose materials for the fabrication of useful articles. A particular metal may have highly desirable properties in some respects coupled with unsatisfactory properties in othe respects. Frequently, for example, a metal which may be desirable for a particular application because of its lightness, cheapness, ease of fabrication, or resistance to corrosion may be unsuitable because it is too soft.

Historically, and even prehistorically, the problem has been handled through alloying; and the invention of bronze, an alloy of copper and tin is regarded as a major milestone in the development of civilization.

In alloys, however, the improvement in certain properties is frequently accompanied by impairment of other properties. Furthermore, it may be desired to improve the hardness of the alloys, themselves.

SUMMARY OF THE INVENTION

In accordance with the instant invention, hardened metals are produced by solidifying a molten metal maintained under the influence of a strong electrostatic field of the order of at least 1000 volts, and preferably substantially higher.

Typically, a metal is either melted in a vessel by the addition of heat thereto, or transferred to a heated vessel in a molten state, subjected to a strong electrostatic field while in the molten state, and then cooled and solidified while still within the strong electrostatic field. The vessel must be electrically insulated from the ground, or from the generator of the electrostatic field. In many cases, the vessel may be a mold and the solidified product is a hard casting in a desired configuration.

It is also contemplated that the method of this invention may be used on molten metal in the form of a thin coating on a substrate, such as a galvanizing zinc coating on steel sheeting or steel tubing. Maintaining the molten metal coating in an electrostatic field while it cools and solidifies produces a hardened coating.

The efficacy of the method of this invention is not dependent on the nature of the metal being treated. While the nature of the structural change in the metal which produces the desired hardness is not understood, the method may nevertheless be applied to any metal which is normally melted and resolidified during fabrication. Among the metals to which the method of this invention may be applied are aluminum, zinc, copper, lead, silver, gold, platinum and other members of the platinum family, lead, magnesium, nickel, tin, iron and alloys containing more than 50 weight percent of the foregoing metals.

The electrostatic field is conveniently produced by an electrostatic generator, such as a Van de Graaff generator, and is conducted to the vicinity of the molten metal by an electrical conductor.

In one embodiment, the molten metal is insulated from the ground and the electrical conductor terminates at an electrode a short distance above the liquid level of the metal bath. Typically, the distance between the electrode and the upper surface of the molten metal may be between about ½ inch and about 10 inches, but the distance is not critical and is dependent on the strength of the field and the size of the charge.

In another embodiment, the molten metal is insulated from the ground and the electrical conductor terminates at an electrode immersed within the bath of molten metal. In this embodiment, the molten bath, because of its electrical conductivity, becomes part of the electrode.

In still another embodiment, the molten metal bath is grounded and the electrical conductor terminates at an electrode a short distance above the level of the molten metal. In this embodiment, the molten metal bath, because of its electrical conductivity, becomes part of the ground.

In accordance with this invention, metals solidified under the influence of a strong electrostatic field are substantially improved in hardness whether the hardness is measured on a surface transverse to the direction of the electrostatic field, or parallel to it.

DETAILED DESCRIPTION

Figure 1:
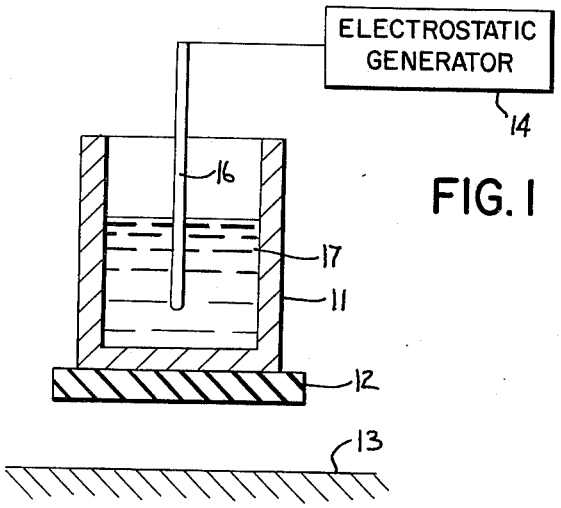
FIG. 1 is a schematic elevation, partially in cross-section, illustrating one embodiment of the invention.

Referring to the drawings and particularly to FIG. 1, crucible 11 rests on support which is spaced from ground 13. Electrostatic generator 14 creates an electrostatic charge relative to ground 13, which charge is transmitted to electrode 16 which has one end immersed within molten metal bath 17 in crucible 11.

Figure 2:
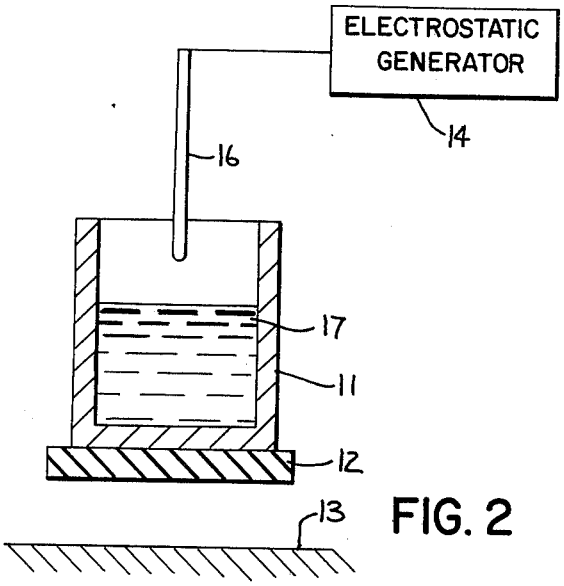
FIG. 2 is a schematic elevation, partially in cross-section, illustrating another embodiment of the invention with respect to the location of the liquid bath in the electrostatic field.

In FIG. 2, elements identical to those of FIG. 1 are identified by the same reference numerals. As may be seen, the embodiment of FIG. 2 differs from that of FIG. 1 in that electrode 16 is not within molten metal bath 17 but rather just above it.

Figure 3:
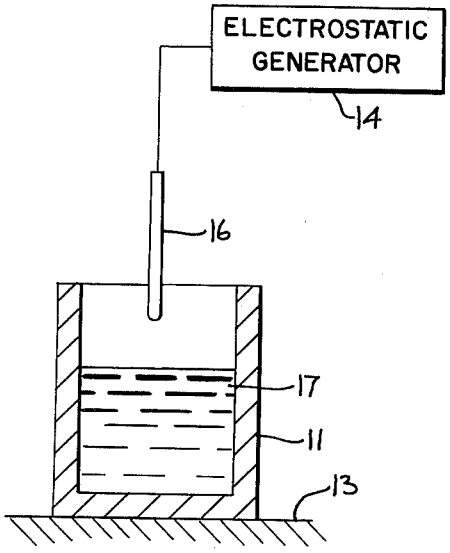
FIG. 3 is a schematic elevation, partially in cross-section, illustrating still another embodiment of the invention with respect to the location of the liquid bath in the electrostatic field.

In FIG. 3, elements identical to those of FIGS. 1 and 2 are similarly numbered. In the embodiment of FIG. 3, crucible 11 rests directly on the ground and is in electrical contact with it while electrode 16 is above and out of contact with the molten metal bath.

Figure 4:
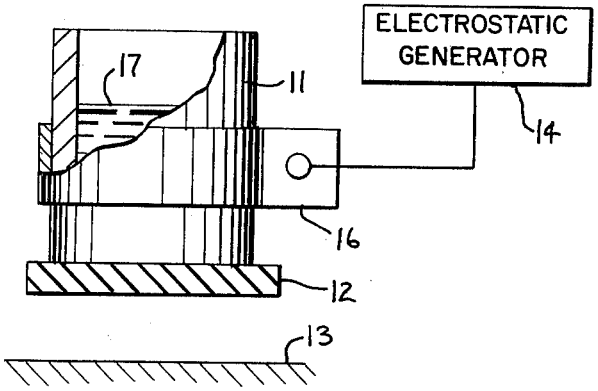
FIG. 4 is a schematic elevation, partially in cross-section, illustrating another embodiment of the invention with respect to electrode configuration.

In FIG. 4, electrode 16, instead of being rod-shaped as in FIGS. 1, 2 and 3, is ring-shaped and circles crucible 11.

Figure 5:
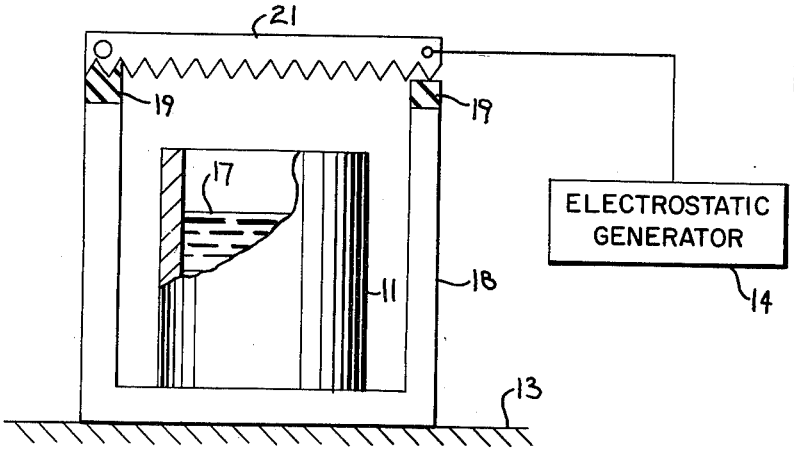
FIG. 5 is a schematic elevation, partially in cross-section, illustrating still another embodiment of the invention with respect to electrode configuration.

In FIG. 5, the electrode is a steel frame 18 within which crucible 11 is supported and which is grounded. Serrated member 21, typically a hacksaw blade, is connected to the electrostatic generator and is separated from the frame by insulating blocks 19. Member 21 is hinged at one of the insulating blocks so that the frame may be opened for insertion and removal of the crucible. When the electrostatic generator generates an electrostatic charge, the serrations on member 21 spread the generated electrostatic field across the entire width of the molten metal in the crucible.

Figure 6:
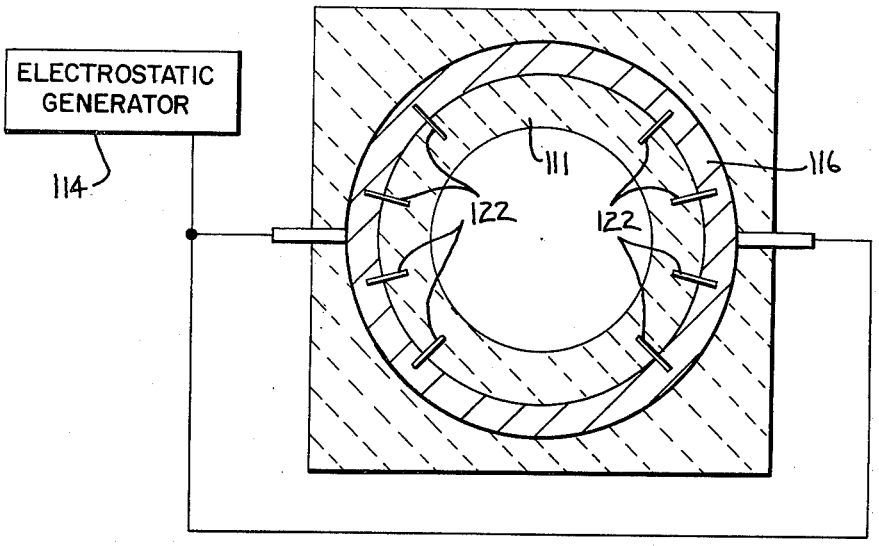
FIG. 6 is a schematic plan view, partially in cross-section, illustrating an electrode configuration particularly adapted for use in the processing of large batches of molten metal in accordance with this invention.

In the embodiment of FIG. 6 (shown in plan view section), crucible 111 is ringed by steel cylinder 116 which is electrically connected to generator 114 and constitutes a portion of the electrode in the system. Steel pins 122 project from steel ring 116 into the cylinder wall of crucible and serve as distribution points for the generated electrostatic field.

Figure 7:
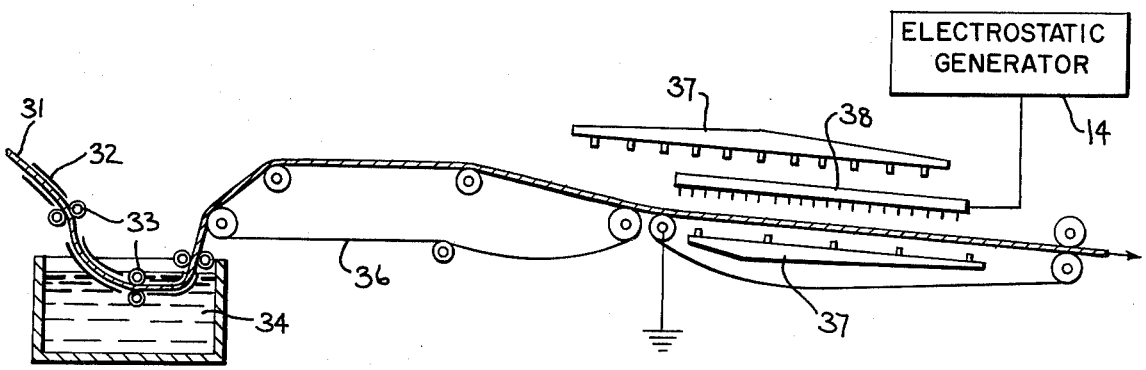
FIG. 7 is a schematic elevation, partially in cross-section, illustrating a production line for improving the hardness of a zinc coating in a galvanizing system.

In the galvanizing system of FIG. 7, steel strip 31 moves toward the right from cleaning baths (not shown) through guides 32 and rollers 33 into molten zinc bath 34 and then passes over conveyor 36 with a thin coating of molten zinc adhering to its surfaces.

Air nozzles 37 direct streams of air against the zinc coated steel strip to cool and solidify the zinc coating and electrode 38, connected to electrostatic generator 14, provides an electrostatic field relative to the steel strip which is grounded.

EXAMPLES 1 TO 10

Solid aluminum was melted in a small crucible (1" diameter) in a series of runs. The electrostatic field conditions were varied in each run and the hardness (Rockwell T scale) of the cooled samples was tested at each edge and in the center of the circular cross-section. In Examples 1 to 5 the electrode was a copper wire. In Examples 6 to 9 the electrode was an ⅛" steel rod, sharpened to a point. In Examples 2 to 5 and 9 the electrode was negative relative to the ground and it was positive in Examples 6 to 8.

The results are shown in Table I.

TABLE I

| | Charge | | Probe | Field Duration | Hardness | | |
|---|---|---|---|---|---|---|---|
| Ex. | Kilovolts | Milliamps | Location | (Min.) | E | C | E |
| 1 | None - Control | | | | 15 | 15 | 14 |
| 2 | 7-14 | 1 | 1" in Al | 35 | 58 | 56 | 58 |
| 3 | 26-27 | 0.0002 | 1" above Al | 20 | 52 | 52 | 52 |
| 4 | 30 | 1 | 1" in Al | 20 | 38 | 38 | 38 |
| 5 | 7-14 | 2 | 1½" above Al | 60 | 52 | 58 | 52 |
| 6 | 25 | 0.0002 | 1¾" above Al | 60 | 50 | 56 | 53 |
| 7 | 21-28 | 0.0002 | ⅛" in Al | 30 | 53 | 53 | 53 |
| 8 | 20 | 0.0002 | 1¾" above Al | 30 | 45 | 45 | 45 |
| 9 | 27 | 0.0002 | 1½" above Al | 33 | 49 | 49 | 49 |
| 10 | None - Control | | | | 11 | 11 | 11 |

Figure 8:
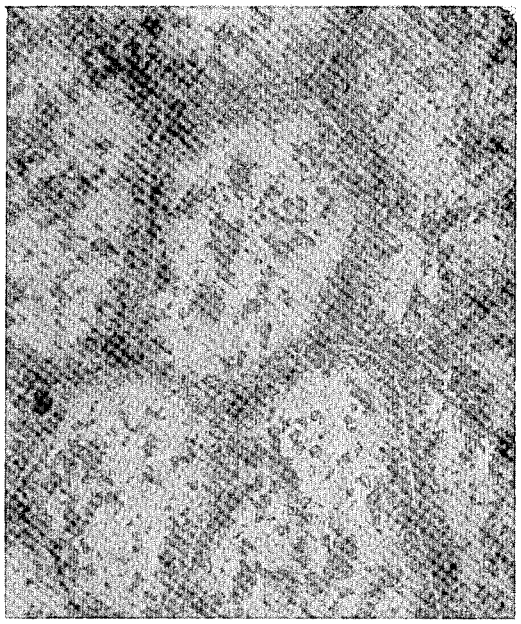
FIGS. 8 and 9 are photomicrographs showing the grain structures, respectively, of cast aluminum hardened in accordance with this invention and cast aluminum solidified from melt in the conventional manner.
Figure 9:
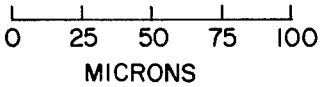
Figure 9:
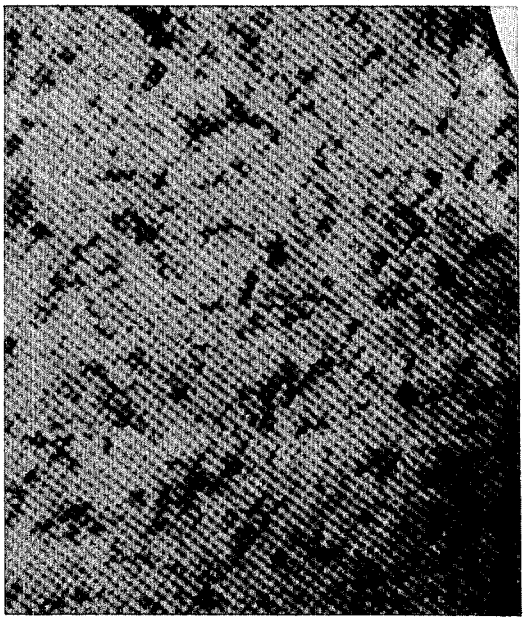

The solid melt from the crucible of Example 2 was cross-sectioned, stained and photomicrographed at 480 diameters and compared with a similarly prepared photomicrograph of a control which was solidified without the application of an electrostatic force. FIG. 8 shows the grain structure of a product of this invention having generally hexagonal, clearly defined, and irregular grains, measuring from about 30 to about 50 microns in width and from about 50 to about 70 microns in length.

EXAMPLES 11 TO 15

The test procedures of Examples 1 to 10 were repeated in runs in which copper chunks were melted in the crucible. The electrode was the sharpened steel rod used in Examples 6 to 9. In Examples 13-15 a graphite cover was used to prevent oxidation of the metals. In Examples 11, 14 and 15 the electrode was negative relative to the ground. The results are shown in Table II.

TABLE II

| | Charge | | Probe | Field Duration | Hardness | | |
|---|---|---|---|---|---|---|---|
| Ex. | Kilovolts | Milliamps | Location | (Min.) | E | C | E |
| 11 | 22 | 0.0002 | 1½" above Cu | 14 | 46 | 47 | 48 |
| 12 | None-Control | | | | 30 | 8 | 8 |
| 13 | None-Control | | | | * | * | * |
| 14 | 21-28 | 0.0002 | 1½" above Cu | 8 | 15 | 20 | 20 |
| 15 | 25-28 | 0.0002 | 1½" above Cu | 5 | 11 | 11 | 11 |

*Copper too soft to be measured on Rockfort T Scale.

The invention has been described with respect to its preferred embodiments. Modification and variations will be apparent to those skilled in the art.

I claim:

1. The method of producing a hardened, normally solid metal which comprises subjecting said metal in a molten state to an electrostatic field produced by a potential difference of at least 1000 volts and maintaining said metal in said field while said metal cools and solidifies.

2. The method of claim 1 wherein said field is positive relative to the ground.

3. The method of claim 1 wherein said field is negative relative to the ground.

4. The method of any one of claim 1, 2 and 3 wherein said field is imposed upon said molten metal by at least one electrode above said molten metal.

5. The method of any one of claims 1, 2 and 3 wherein said field is imposed upon said molten metal by at least one electrode within said molten metal.

6. The method of any one of claims 1, 2 and 3 wherein said field is imposed upon said molten metal by at least one electrode around said molten metal.

7. The method of any one of claims 1, 2 and 3 wherein said metal is a metal of the group consisting of zinc and alloys containing more than 50 weight percent of zinc.

8. The method of any one of claims 1, 2 and 3 wherein said metal is a ferrous metal.

9. The method of any one of claims 1, 2 and 3 wherein said metal is a metal of the group consisting of aluminum and alloys containing more than 50 weight percent of aluminum.

10. The method of any one of claims 1, 2 and 3 wherein said metal is a metal of the group consisting of copper and alloys containing more than 50 weight percent of copper.

11. The method of any one of claims 1, 2 and 3 wherein said molten metal is in a mold when it is solidified in said field.

12. The method of any one of claims 1, 2 and 3 wherein said molten metal is in the form of a thin coating on a substrate when it is solidified in said field.

13. The method of claim 12 wherein said molten metal is a galvanizing coating of zinc on a substrate of steel when said molten metal is solidified in said field.

14. Apparatus for the hardening of a metal comprising a vessel for molten metal which vessel is electrically insulated from the ground, a generator for an electrostatic field relative to the ground, and an electrode connected to said generator, said electrode being located in or near said vessel.

15. A hardened metal produced by the method of claim 1.

16. A hardened aluminum having a microstructure comprising generally hexagonal, irregular grains measuring from about 30 to about 50 microns in width and from about 50 to about 70 microns in length.

17. The method of claim 1 wherein said metal is aluminum and said potential difference is at least 7 kilovolts.

18. The method of claim 1 wherein said metal is copper and said potential difference is at least 21 kilovolts.

* * * * *